US007118055B2

(12) United States Patent
Chang

(10) Patent No.: US 7,118,055 B2
(45) Date of Patent: Oct. 10, 2006

(54) GRINDING MILL

(76) Inventor: Jin-Hong Chang, No. 1131-1, Fu-Hsin Road, Hsin Ying City, Tainan Hsien (TW)

( * ) Notice: Subject to any disclaimer, the term of this patent is extended or adjusted under 35 U.S.C. 154(b) by 120 days.

(21) Appl. No.: 10/828,852

(22) Filed: Apr. 19, 2004

(65) Prior Publication Data

US 2005/0230508 A1 Oct. 20, 2005

(51) Int. Cl.
*B02C 4/32* (2006.01)

(52) U.S. Cl. ..... 241/79.1; 241/131

(58) Field of Classification Search ..... 241/56, 241/79.1, 129, 130, 131, 132, 133
See application file for complete search history.

(56) References Cited

U.S. PATENT DOCUMENTS 5,238,196 A * 8/1993 Chang ..... 241/56

* cited by examiner

*Primary Examiner*—Mark Rosenbaum
(74) *Attorney, Agent, or Firm*—Pro-Techtor Int'l Services

(57) ABSTRACT

A grinding mill comprises a suction device, a separator, a grinding device, and a driving device. The grinding device has a grinding ring, a grinding wheel, mounted on an excentric disc, a strong elastic plate assembly and several adjusting elements allowing to adjust a distance and a mutual orientation between the grinding wheel and the grinding ring as well as a grinding force. The elastic plate assembly attenuates excess grinding forces and thus prevents damaging of the grinding device. The separator has two support rings and a plurality of blades to separate ground micro-sized particles.

11 Claims, 15 Drawing Sheets

GRINDING MILL

FIELD OF THE INVENTION

The present invention relates to a grinding mill, particularly to a grinding mill having a regulating device precisely controlling distance and relative orientation between inner grinding wheels and an outer grinding ring for a better grinding effect, further having a strong elastic plate assembly for attenuating large pressure to prevent damaging of the grinding wheels and ring, furthermore having a separator with several blades mounted on support rings allowing grinded particles to be let out and collected.

DESCRIPTION OF RELATED ART

With increasing quality of life, demands on industrial products have become stricter. In particular, food and medical production has become subjected to environmental standards. The GMP standard regulates grinding mills as to ingredients, iron contents (resulting from wear), noise, temperature, and pollution. So far, few grinding mills of those produced in all countries fulfill the GMP standard.

Conventionally, grinding mills are designed according to the following criteria: (1) torque, (2) centrifugal force, (3) grinding force, (4) heat, and (5) noise. These criteria are interconnected. When driving a grinding mill by a motor and a shaft, torque results, and grinding stones are by a centrifugal force driven outward, providing a grinding force for grinding. At the same time, heat and noise are generated as adverse effects not to be ignored. In former designs of grinding mills, like in the Raymond Ring-Roll Mill, rotational speed and thus torque and grinding force were fixed. If the grinding force of such a conventional grinding mill turns out to be insufficient or production is to be increased, there is no choice but to replace the motor to provide higher torque. However, arbitrary increasing of motor power leads to higher pressure causing increased wear of grinding stones and mechanical parts as well as to heat and noise generation If pressure becomes too high, the crystal structure of the grinding material is rearranged, inhibiting more effective grinding.

Conventional grinding mills have already undergone improvements regarding ground material, yet do not fulfill the strict GMP standard.

In U.S. Pat. No. 5,238,196 "Upright lever pressure type mill", the present inventor has disclosed a grinding mill which has inner grinding stones pushed against an outer grinding stone by an elastic force and a lever force, minimizing collisions and wear. However, this design still has the following shortcomings:

1. During the grinding process, strong vibrations are attenuated by springs. After prolonged operation, however, material fatigue readily causes breaking of the springs. When hard materials, such as minerals, ceramics, zirconium oxide, titanium alloy and metal oxides, are ground, the grinding force is not sufficient and the grinding stones are displaced from parallel orientations, hampering the grinding effect thereof. Furthermore, if the elastic force of the spring is insufficient, vibrations are not attenuated and damage as well as excessive metal content and pollution of grinded products result.
2. In order to take on large grinding forces, large springs with high elastic forces have to be employed, requiring a large space. On the other hand, space is limited, and a pressure system cannot be accommodated. Furthermore, too complicated structural parts and too many dead angles make cleaning difficult.

For appropriate operation, parallel orientations of inner and outer grinding stones are important. During the grinding process, the inner and outer grinding stones easily collide due to pressure and friction. If the grinding force is sufficiently large, the inner and outer grinding stones do not need to touch each other, allowing for effective grinding.

SUMMARY OF THE INVENTION

It is an object of the present invention to provide a grinding mill having inner and outer grinding stones the distance of which is regulated and which are kept parallel to each other and where excessive pressure is attenuated.

Another object of the present invention is to provide a grinding mill which is capable of bearing high pressure and attenuating vibrations and which allows to let out and collect grinded products.

The present invention can be more fully understood by reference to the following description and accompanying drawings.

DETAILED DESCRIPTION OF THE PREFERRED EMBODIMENTS

As shown in FIGS. 1–3, the grinding mill of the present invention mainly comprises: a main body 10, accommodating structural parts for grinding; a suction assembly 20, connected with a collecting apparatus 71 for collecting grinded products; a separator 30, separating ground products according to sizes thereof; a grinding device 40; several regulating devices 50; and a driving device 60.

The suction assembly 20 is placed on an upper end of the main body 10. The separator 30, the grinding device 40 and the regulating devices 50 are housed inside the main body 10. A feeding hole 11 connected to a feeding apparatus 70 is cut into the main body 10, providing raw material to be ground. The main body 10 further has a lower end with a resupplying chamber 12. The resupplying chamber 12 has a resupplying hole 121 which via a resupplying tube 72 takes in excess air from the collecting apparatus 71, which is subsequently led back into the main body 10. A draining chamber 13 is placed at the lower end of the main body 10. A draining tube 131 leads from the draining chamber 13 to a waste chamber 14 where non-grindable components and waste from the grinding process are collected.

The suction assembly 20 has an upper end with a motor bearing, a lower end which is connected with the upper end of the main body 10 and an inner space which accommodates a high-speed separator motor 22 and a separator shaft 21 that vertically reaches downwards. A frequency controller controls a centrifugal force of a separator movement around the separator shaft 21 that is needed for appropriate separation. The separator 30 has a drum body 35, 35*a*, 35*b*, 35*c*, allowing precisely to regulate a degree of coarseness of separated particles. A suction tube 23 leads laterally away from the suction assembly 20 into a fan apparatus 73, so that particles separated by the separator 30 are sucked out of the main body 10.

Referring to FIGS. 1–4, the separator 30 is fixed on the separator shaft 21 within the main body 10 and comprises two support rings 31 and a plurality of blades 32. The two support rings 31 are symmetrically disposed on upper and lower sides of the separator 30. Arc-shaped openings 311 and are cut in each of the two support rings 31. Fixing holes 312 surround the sectorial openings 311 on each of the two support rings 31. The blades 32 are radially oriented and respectively fixed by vertical rods 321 in the fixing holes 312. The openings 311 let small particles pass, while larger particles are driven out between the blades 32 by the centrifugal force of the separator movement to fall down into the grinding system 40 and to be ground further.

Referring to FIGS. 2–5, the separator 30 has a guiding assembly 340 placed in an upper part of the main body 10. The drum body 35 is placed above a circular pan 34, with a gap C1 remaining in between. The pan 34 is fixed on the separator shaft 21 at an adjustable vertical position. Thus an air flow and a radius of vortices is controlled. For example, for grinding small particles the gap C1 is adjusted to a small value, like C2 in FIG. 4B. The drum body has a peripheral surface into which openings 351 are cut. The openings 351 are partly covered by inclined lids 352, so as to form an air flow that carries particles along with the centrifugal force. Thus the separator 30 works like a sieve, so that larger particles are brought outward to fall down along inner walls of the main body 10 and to be reinserted into the grinding process. Smaller particles stay in an inner air flow and rise along the separator shaft 21. Thus an air flow is controlled that leads larger particles outward to be further grinded, allowing for repeated grinding down to micro-sizes. Larger particles are led out by the centrifugal force of the rotational movement at high speed, so that effective sieving of particles down to micro-sizes is attained.

Referring again to FIGS. 3–5*a*, in an embodiment of the present invention, a drum body 35*a* is used having an upper edge with an extension ring 34*a* that is vertically adjustable, providing additional space for separating larger particles through the blades 32.

Referring to FIG. 5*b*, in another embodiment of the present invention, a drum body 35*b* is used having lids 353 that are inclined inwards. As shown in FIG. 5*c*, in a further embodiment of the present invention, a drum body 35*c* is used having lids 354, 355 that are alternatingly inclined inwards and outwards for adjusting to the air flow carrying particles.

Referring now to FIGS. 6–9 and 13, the grinding device 40 is placed inside the main body 10, surrounded by a grinding ring 15. The grinding device 40 has a main axis 41 which is driven by the driving device 60 to perform a rotational grinding movement. An excentric disc 42 is set on the main axis 41, carrying a plurality of grinding wheels 43 arranged to have suitable distances to the grinding ring 15. Ramps 421, each placed next to one of the grinding wheels 43 on the excentric disc 42, guide raw material into two vertical sections between the grinding wheels 43 and the grinding ring 15, preventing accumulation thereof. Furthermore, air inlets 422 are placed on the excentric disc 42, covered by hinged lids 423. The lids 423 freely open in the airflow that is driven by the fan apparatus 73.

The driving device 60 has a main motor 61 which drives the grinding device 40. The main motor 61 extends into a casing 62, driving the grinding movement of the main axis 41. A gearbox is accommodated by the casing 62, allowing for high, middle and low speeds of the grinding movement according to raw material for optimum throughput.

For operating the grinding mill of the present invention, first the separator motor 22, then the main motor 61 are turned on. Consequently, the main axis 41 and the excentric disc 42 perform the grinding movement, causing the grinding wheels 43 to revolve inside of the grinding ring 15, performing the grinding process.

After switching on the fan apparatus 73, air enters the main body 10 through resupplying tube 72, the resupplying hole 121 and the air inlets 422. At the same time, raw material enters the main body 10 through the feeding hole 11. Entering raw material is not carried away by air flow due to large particle sizes and rather falls directly on the excentric disc 42 within the grinding ring 15. The rotating grinding movement of the excentric disc 42 causes raw material to be led along the ramps 421 on two vertical sections between the grinding wheels 43 and the grinding ring 15 and to be ground. Ground material rises with the air flow, entering the separator 30, and is separated there, with smaller particles being carried away to the suction tube 23 and larger particles falling back into the main body 10. Outflowing air is recycled back through the resupplying hole 121 and the air inlet 422, preventing raw material from accumulating.

Referring to FIGS. 6–12, each of the regulating device 50 of the present invention is attached to one of the grinding wheels 43, comprising a base 432 with a through hole 431 and an elastic plate assembly 433 extending downward from the base 432 and made of alloyed steel (like a spring used in trucks) and having a far end with a longitudinally oriented elongated incision 434. The elastic plate assembly 433 has a predetermined deformation characteristic and is made of a single plate or a plurality of plates.

The excentric disc 42 has a periphery into which several incisions 441 are cut for accommodating seats 44 of the grinding wheels 43, into which one of the bases 432 of the grinding wheels 43 is put. Each of the seats 44 has a lower side from which an extension piece 442 extends downward. The extension piece 442 has a lower end into which a threaded hole 446 is cut and an outer side along which the elastic plate assembly 433 of one of the regulating devices 50 runs. Each of the seats 44 has an outer side which is partly covered by a covering plate 443 and two lateral sides into each of which a horizontal elongated hole 444 is cut. For each of the seats 44, a first adjusting element 45 is put through the elongated holes 444 and the through hole 431 of one of the regulating devices 50 and secured by nuts. If desired, a protecting ring is added to obtain an increased fastening area. The covering plate 443 has a threaded hole 447 in a central position through which a second adjusting element 46, for example a screw, is put to press against the elastic plate assembly 433. A third adjusting element 47, for example a screw, passes through the elastic plate assembly 433 at the far end thereof and is screwed into the threaded hole 446, positioning the elastic plate assembly 433. Thus a grinding force of each of the grinding wheels 43 is adjusted.

For each of the grinding wheels 43, the first adjusting element 45 provides for positioning thereof, the second adjusting element 46 adjusts a distance thereof to the grinding ring 15 and maintains a parallel orientation thereof with respect to the grinding ring 15. The distances between the grinding wheels 43 and the grinding ring 15 and the mutual orientations thereof are important for effective grinding. Preventing the grinding wheels 43 and the grinding ring 15 from touching each other, with only ground material placed in between, ensures optimum grinding. For each of the grinding wheels 43, the first adjusting element 45 is adjusted by gliding in the elongated holes 444, taking along the corresponding grinding wheel 43. The second adjusting element 46 presses against the base 432 of the grinding wheel 43, allowing to regulate the distance thereof to the grinding ring 15 and to ensure parallel orientation thereof with respect to the grinding ring 15. The elastic force of the elastic plate assembly 433, pulls the grinding wheel 43 outward, towards the grinding ring 15, at the same time attenuating any excessive grinding force to prevent damaging of the grinding wheels 43.

The extension piece 442 of each of the seats 44 at the lower end thereof has a sweeping plate 445, which during the rotating grinding movement sweeps non-grindable material and waste in the draining chamber 13 into the draining tube 131 to fall into the waste chamber 14.

As the above explanation shows, the grinding mill of the present invention offers the advantages of (1) adjustability of distances between the grinding wheels and the grinding ring and the mutual orientations thereof, (2) attenuating of excessive grinding force, and (3) the capability of separating and collecting tiny particles.

While the invention has been described with reference to preferred embodiments thereof, it is to be understood that modifications or variations may be easily made without departing from the spirit of this invention which is defined by the appended claims.

Figure 1:
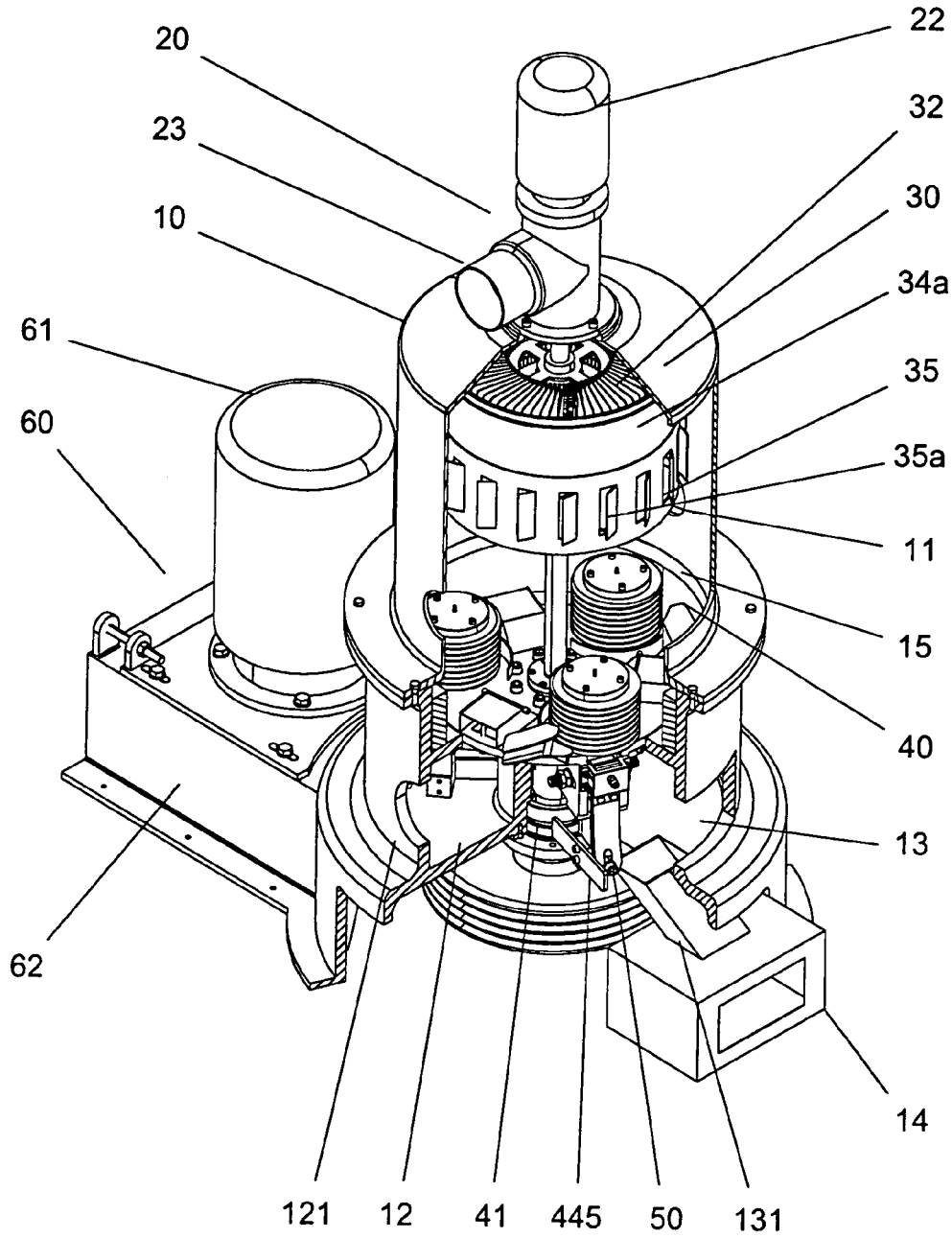
FIG. 1 is a partial sectional view of the grinding mill of the present invention.
Figure 2:
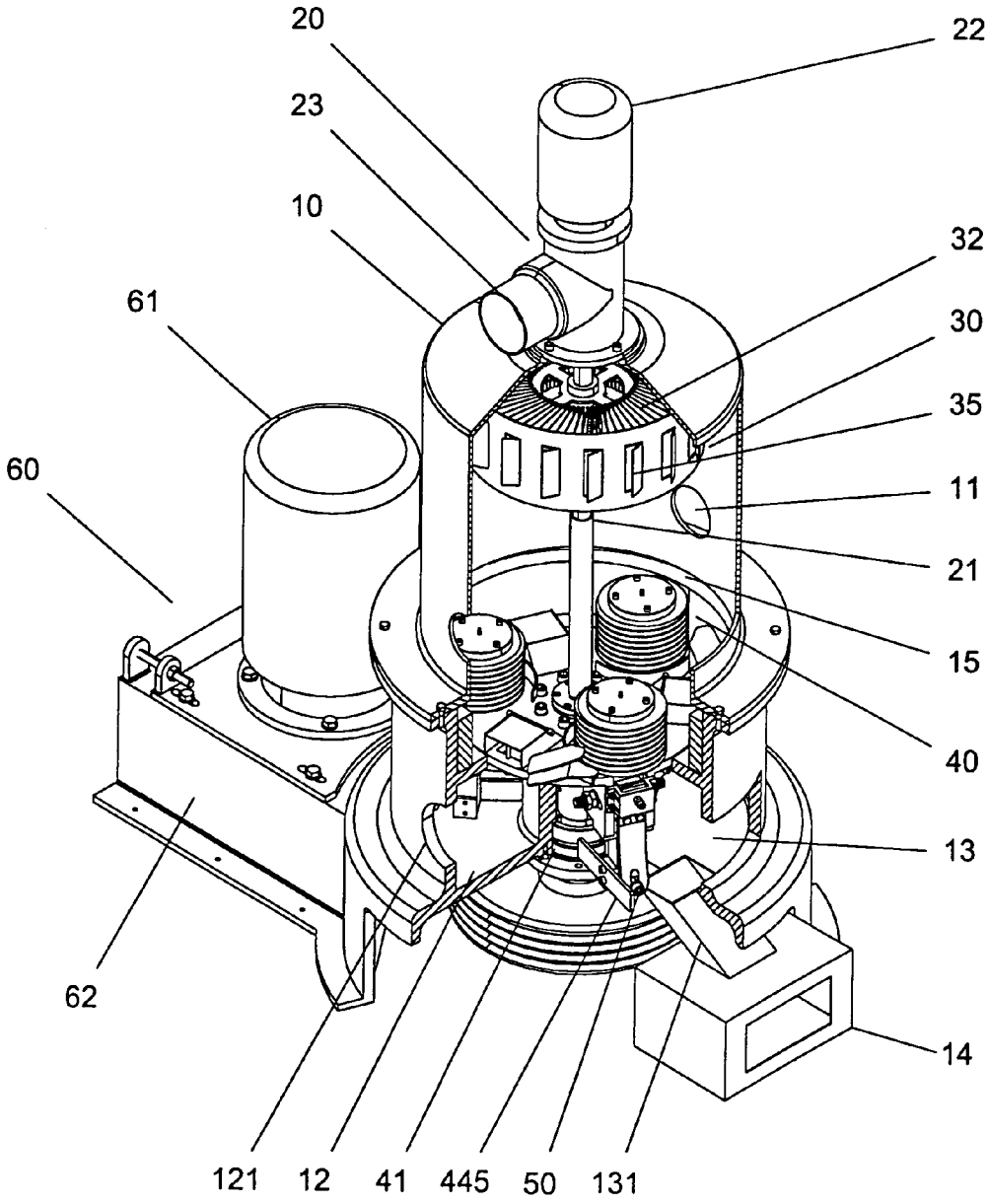
FIG. 2 is a partial sectional view of the grinding mill of the present invention with the separator assembled.
Figure 3:
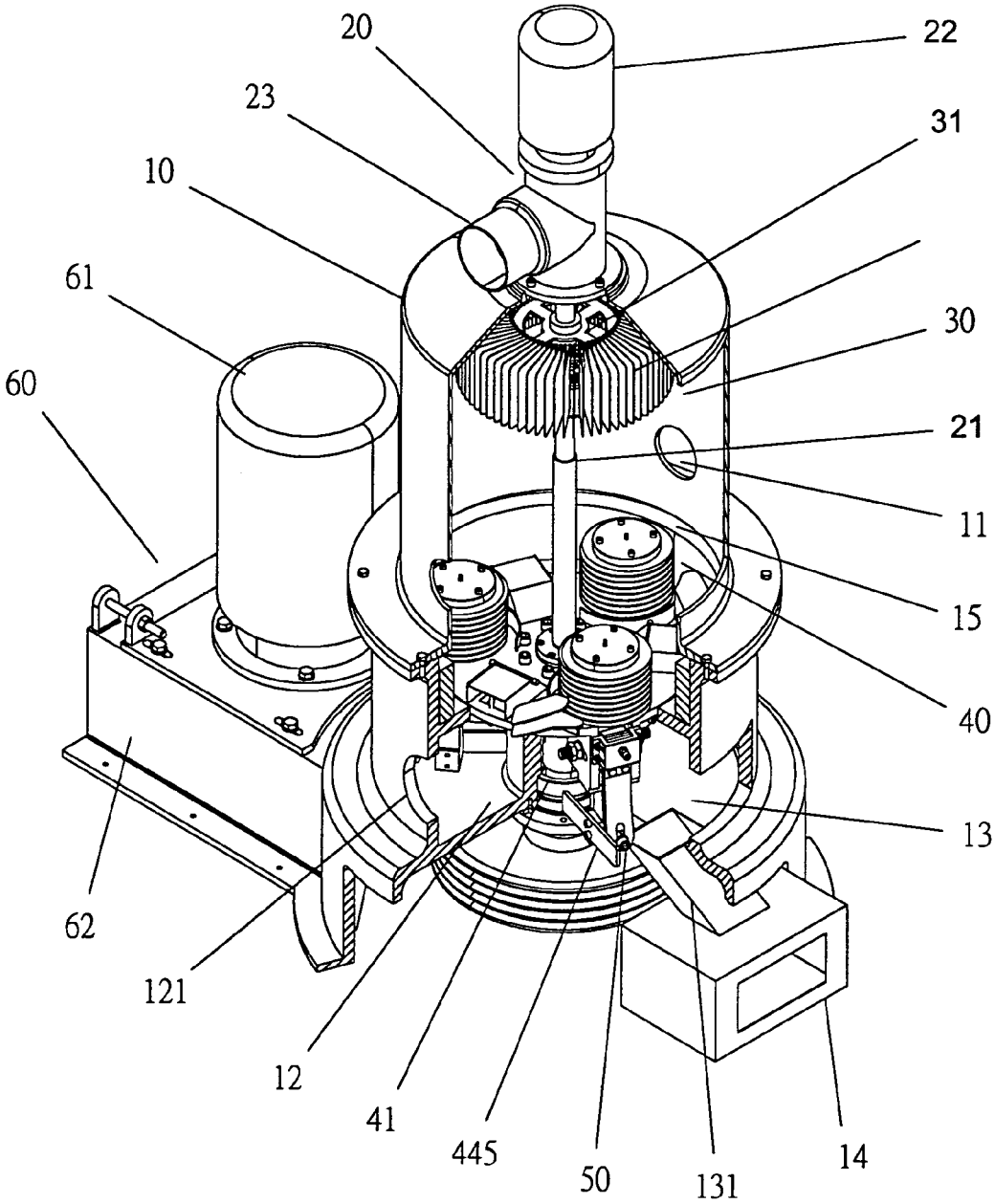
FIG. 3 is a partial sectional view of the grinding mill of the present invention with the separator assembled in another embodiment.
Figure 4:
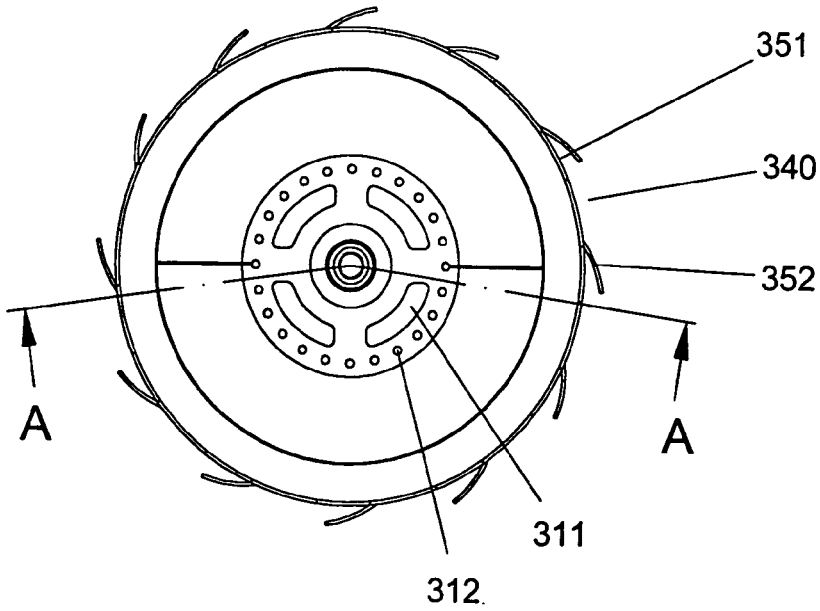
FIGS. 4–4B are views of the separator of the present invention, showing relative positions of structural parts.
Figure 4:
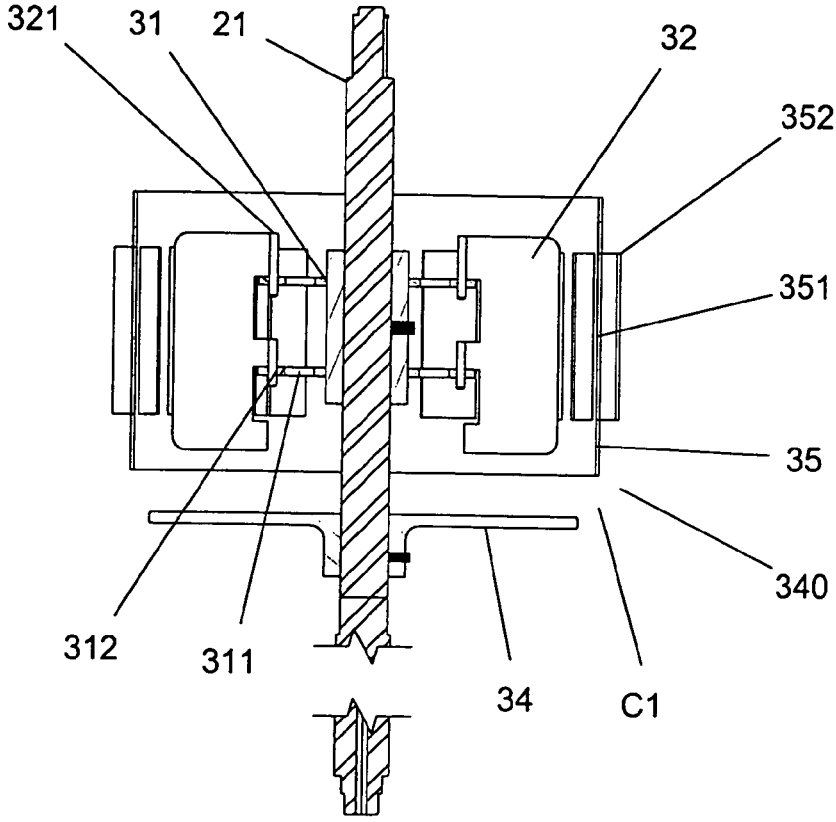
Figure 4A:
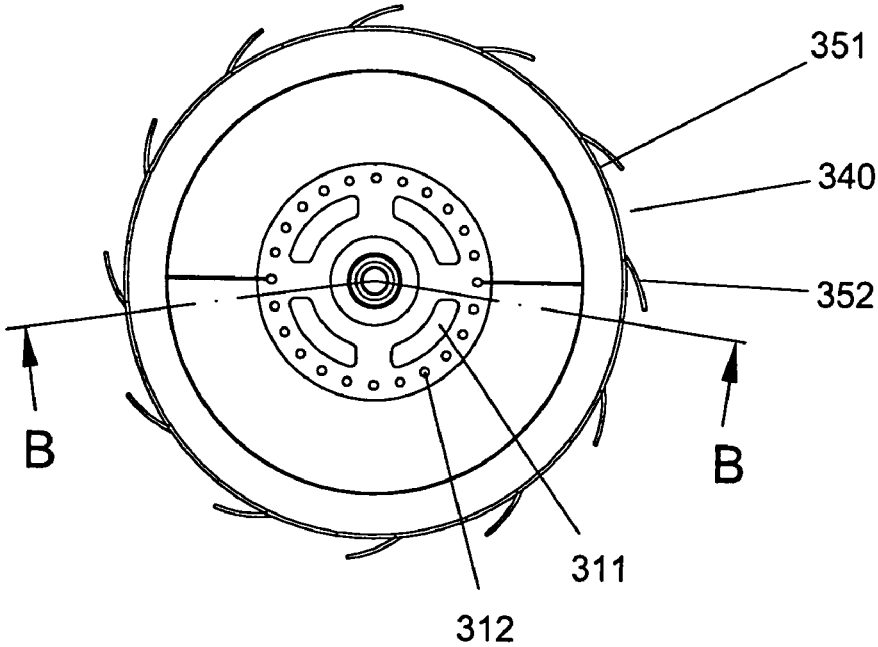
Figure 4A:
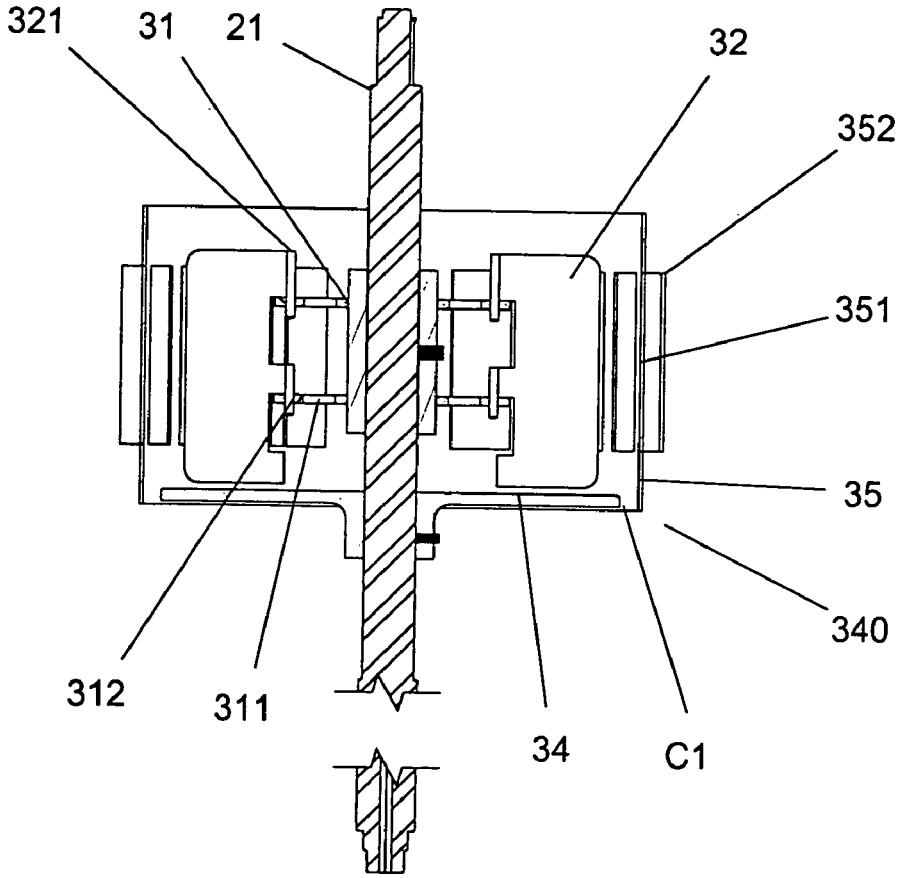
Figure 5:
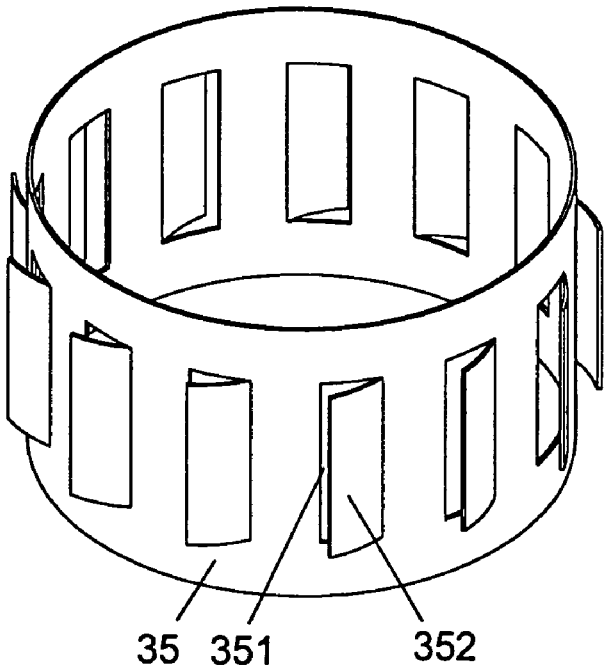
FIGS. 5–5*c* are perspective views of the drum body of the present invention in various embodiments.
Figure 5A:
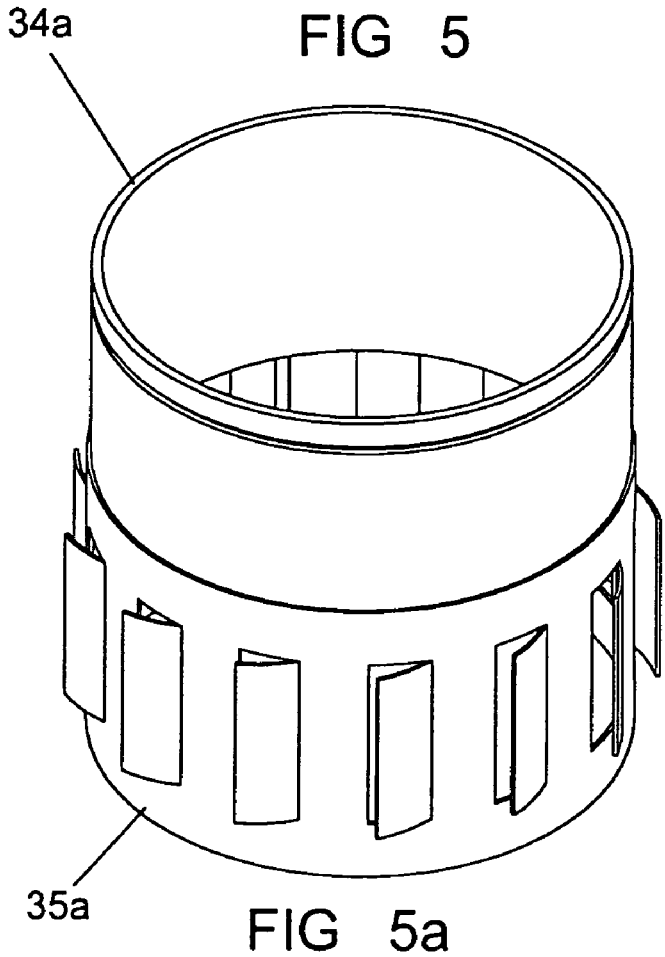
Figure 5B:
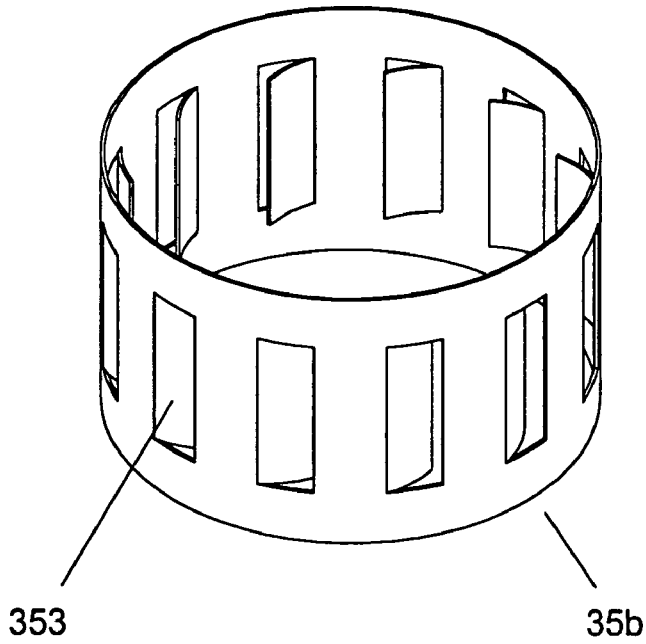
Figure 5C:
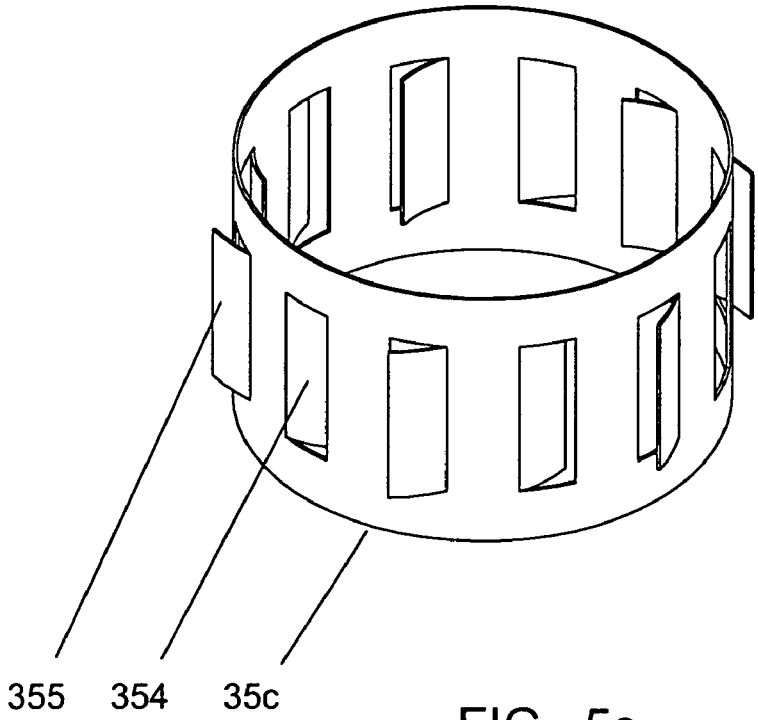
Figure 6:
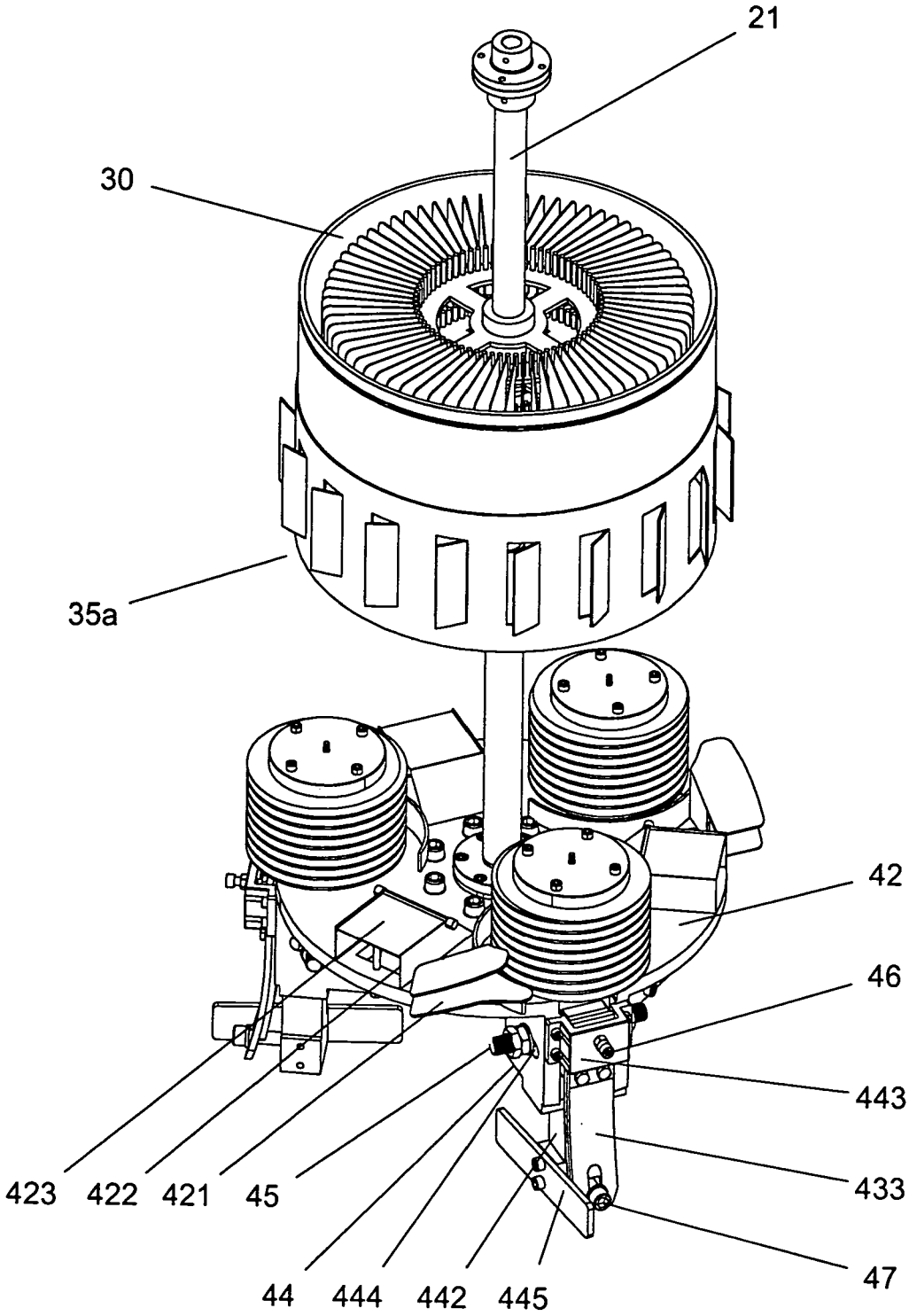
FIG. 6 is a perspective view of the separator and the grinding device of the present invention.
Figure 7:
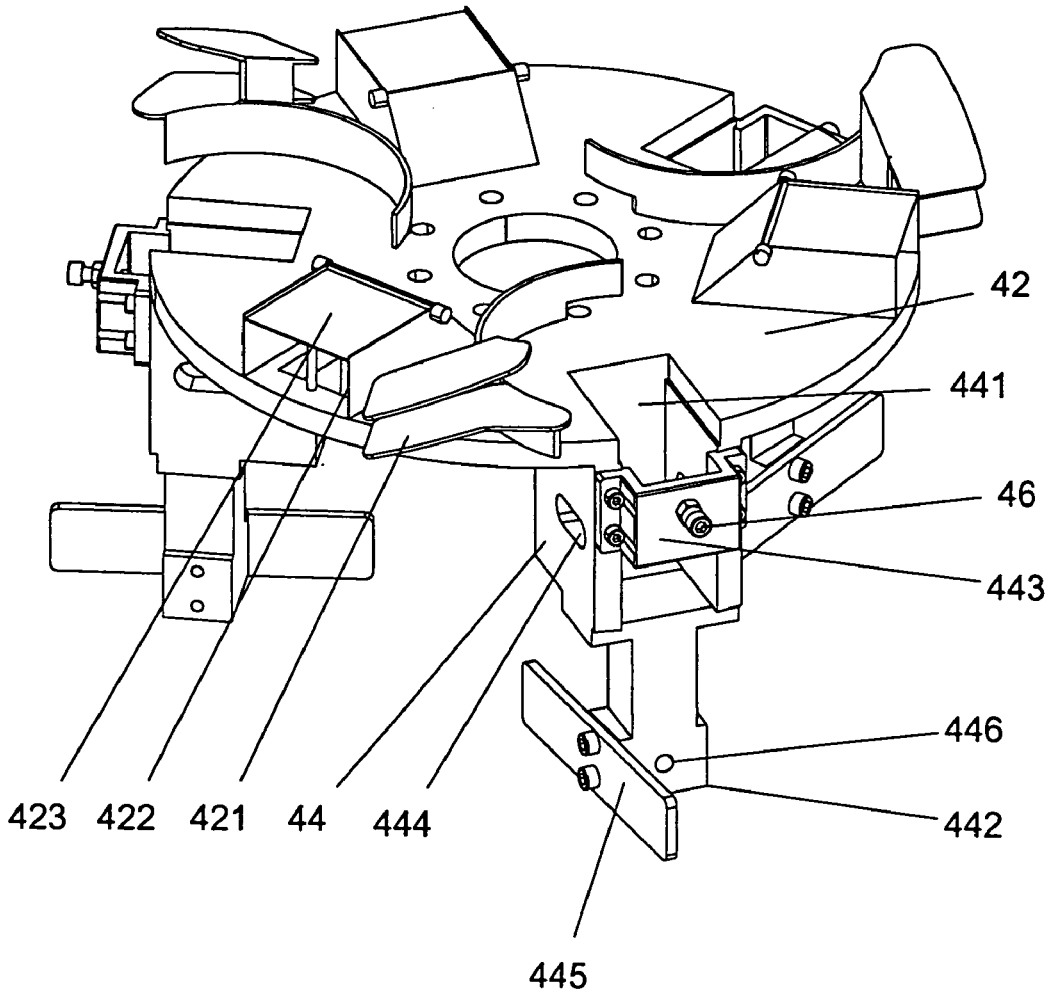
FIG. 7 is a perspective view of the excentric disc of the present invention.
Figure 8:
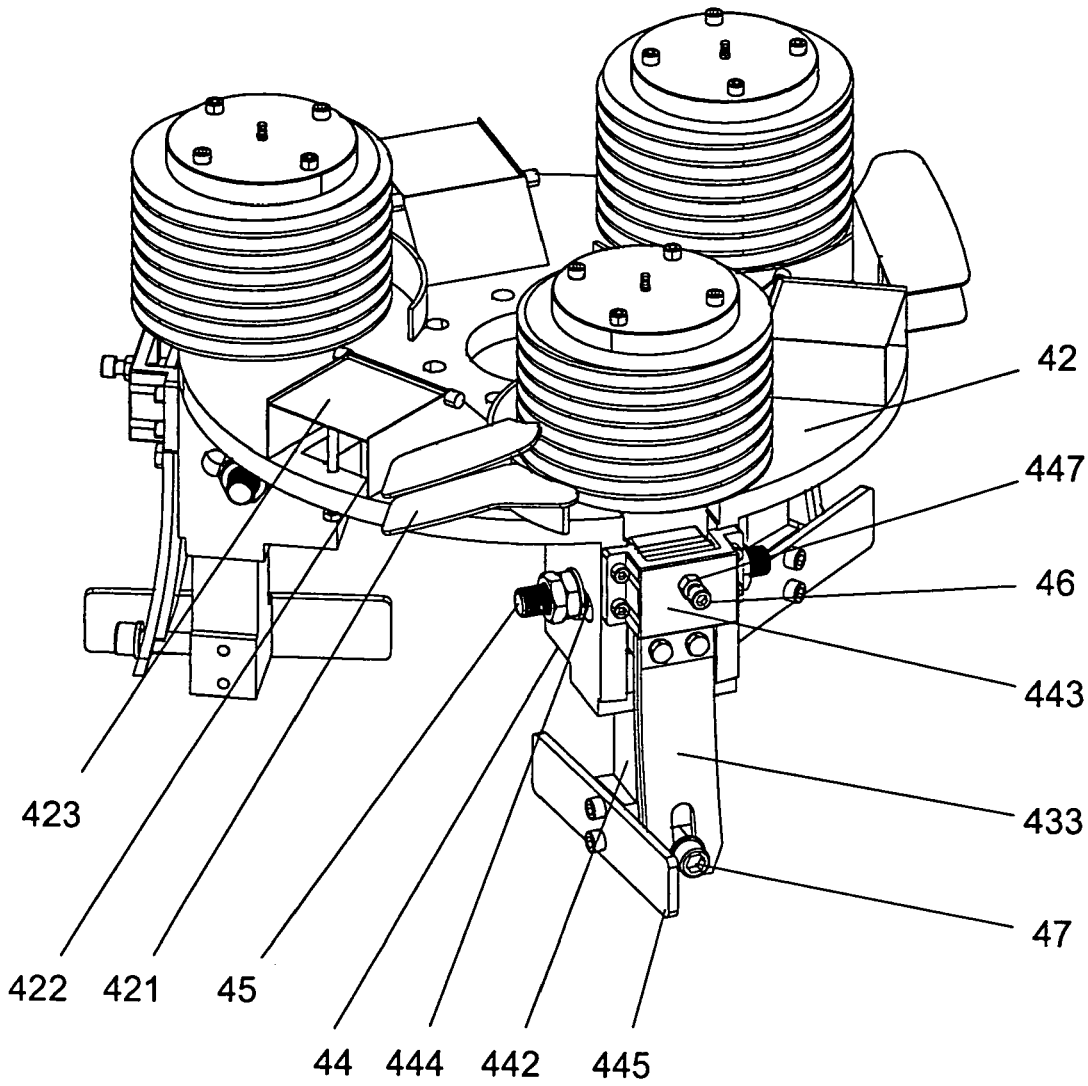
FIG. 8 is a perspective view of the excentric disc of the present invention with the grinding wheels mounted.
Figure 9:
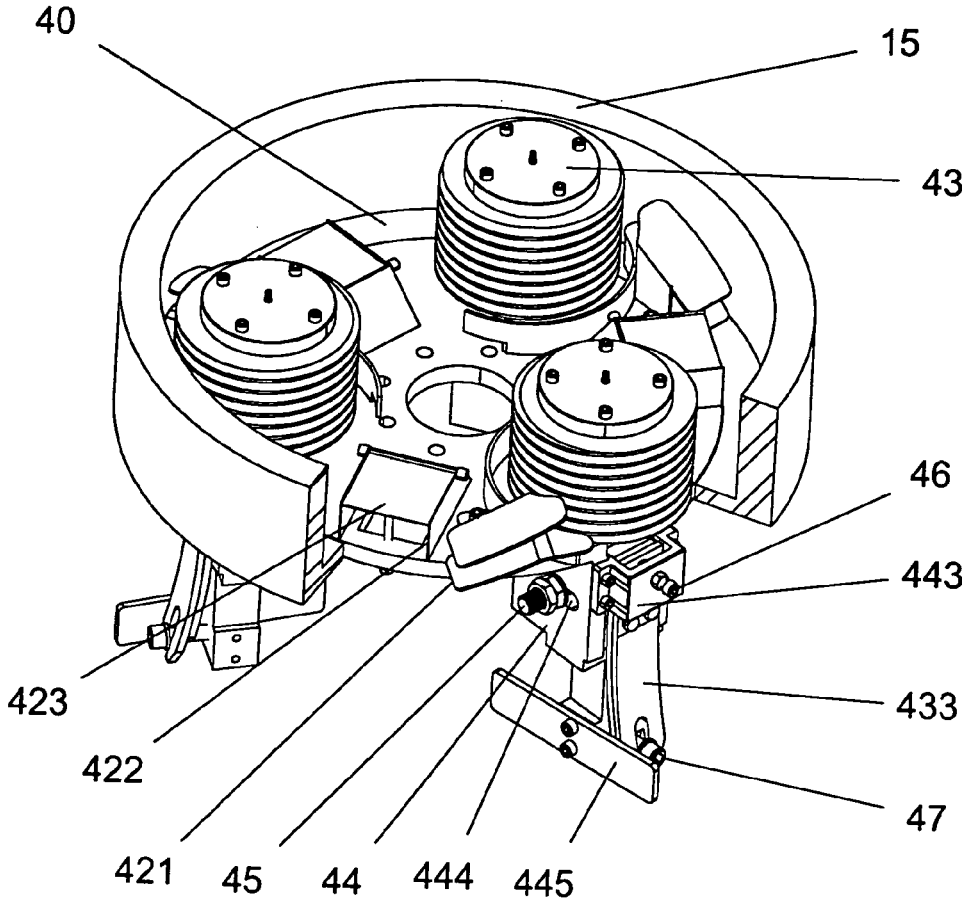
FIG. 9 is a perspective view of the grinding device of the present invention.
Figure 10:
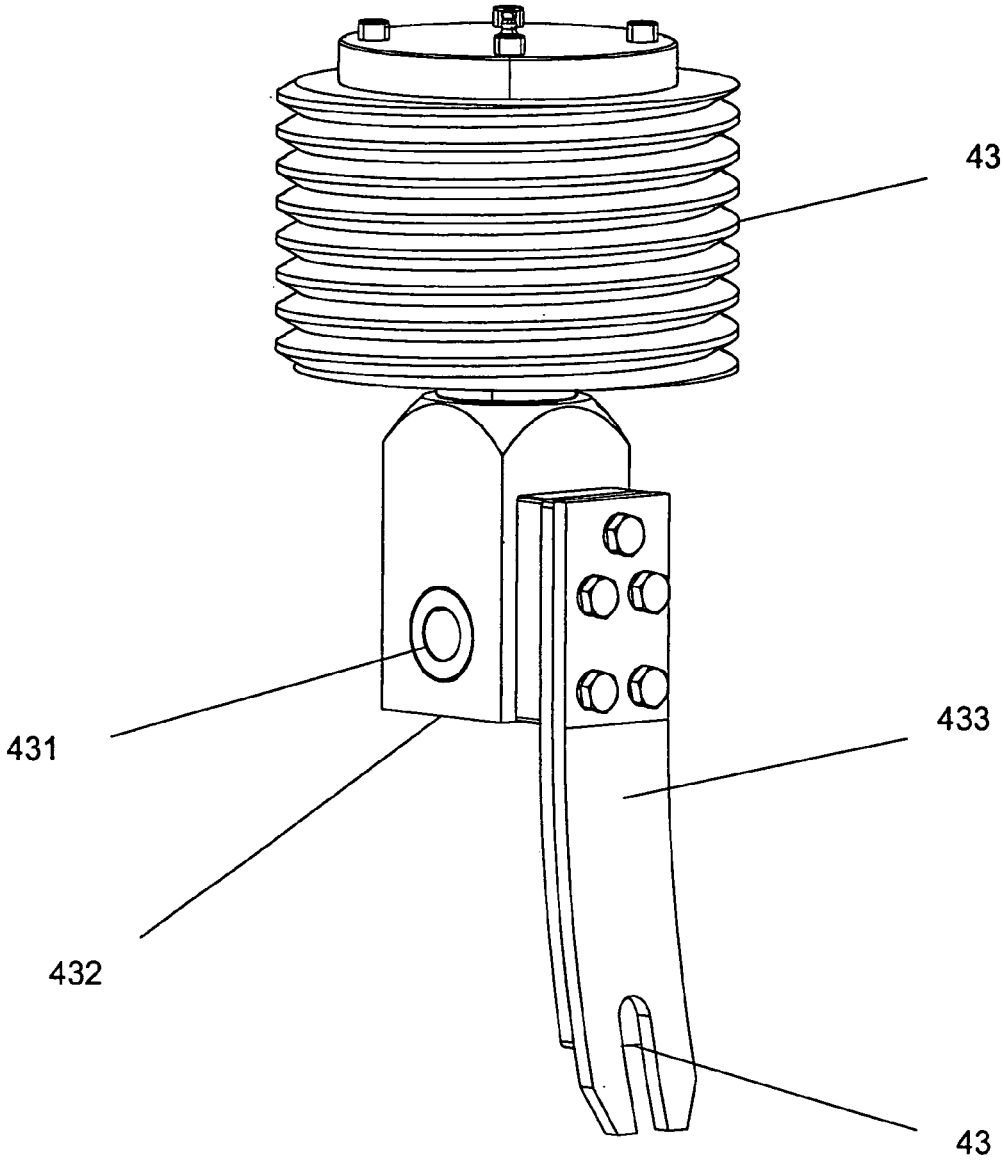
FIG. 10 is a perspective view of one of the grinding wheels of the present invention.
Figure 11:
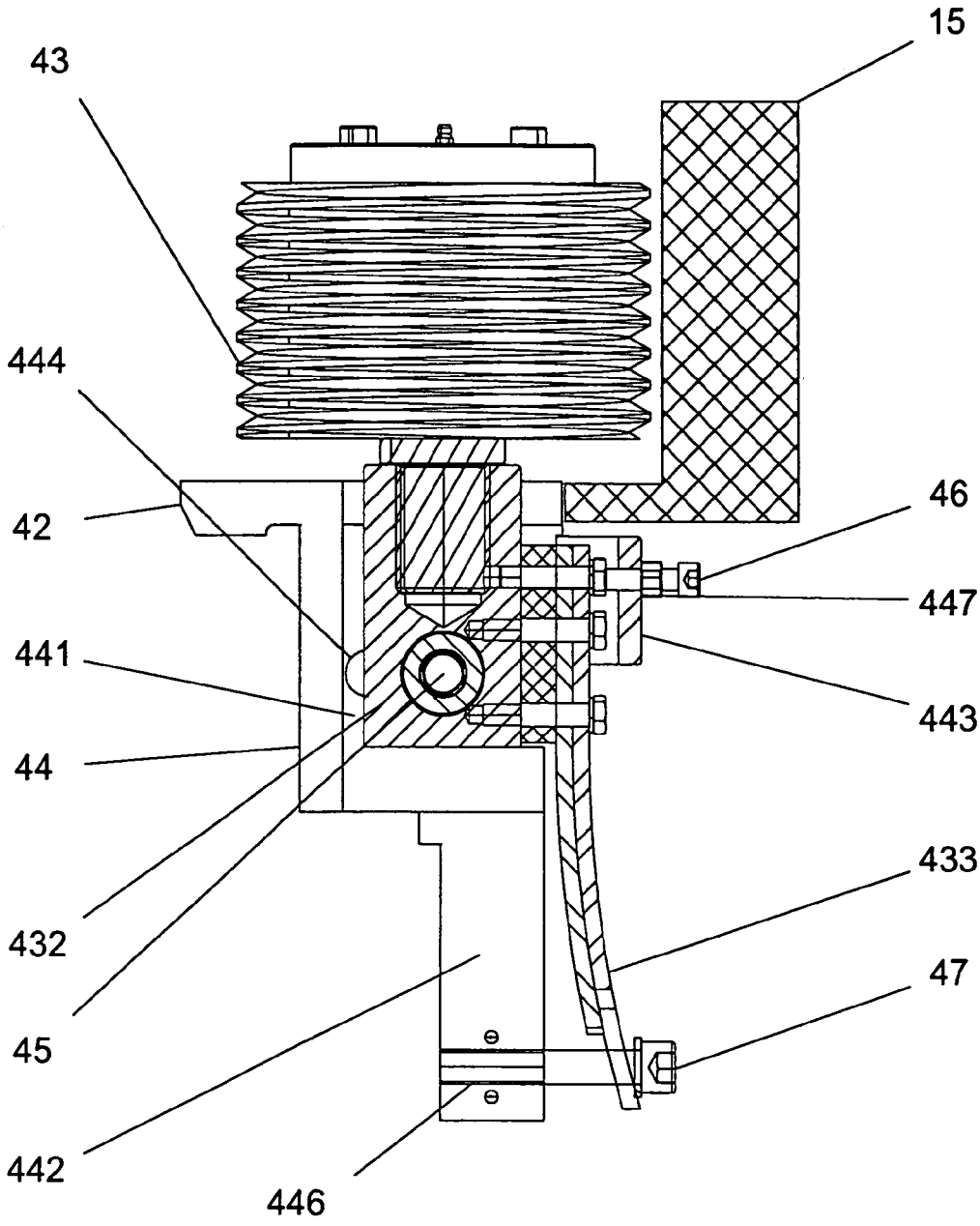
FIG. 11 is a sectional view of one of the grinding wheels and regulating devices and the grinding ring of the present invention.
Figure 12:
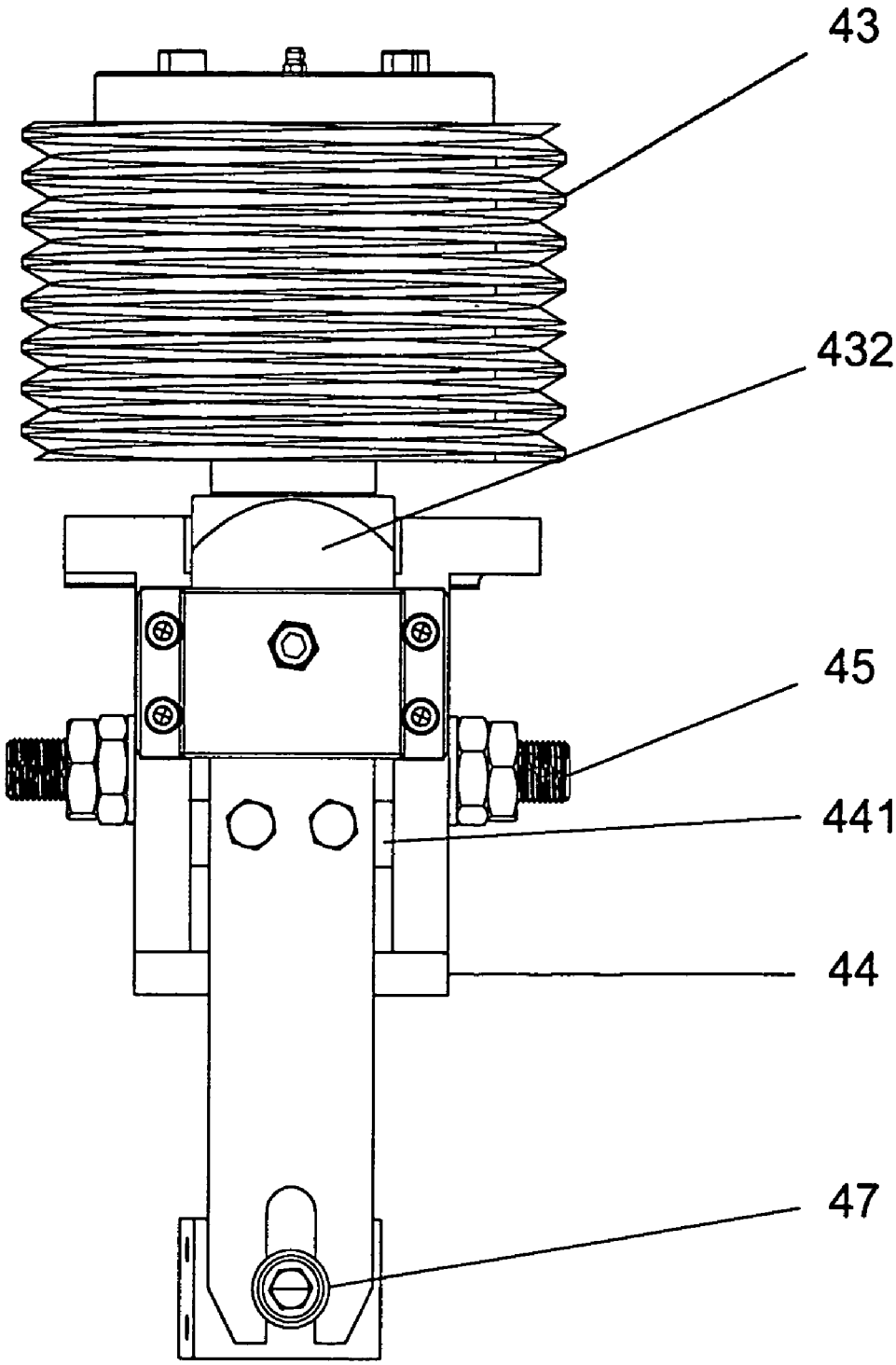
FIG. 12 is a side view from outside of one of the grinding wheels and regulating devices of the present invention.
Figure 13:
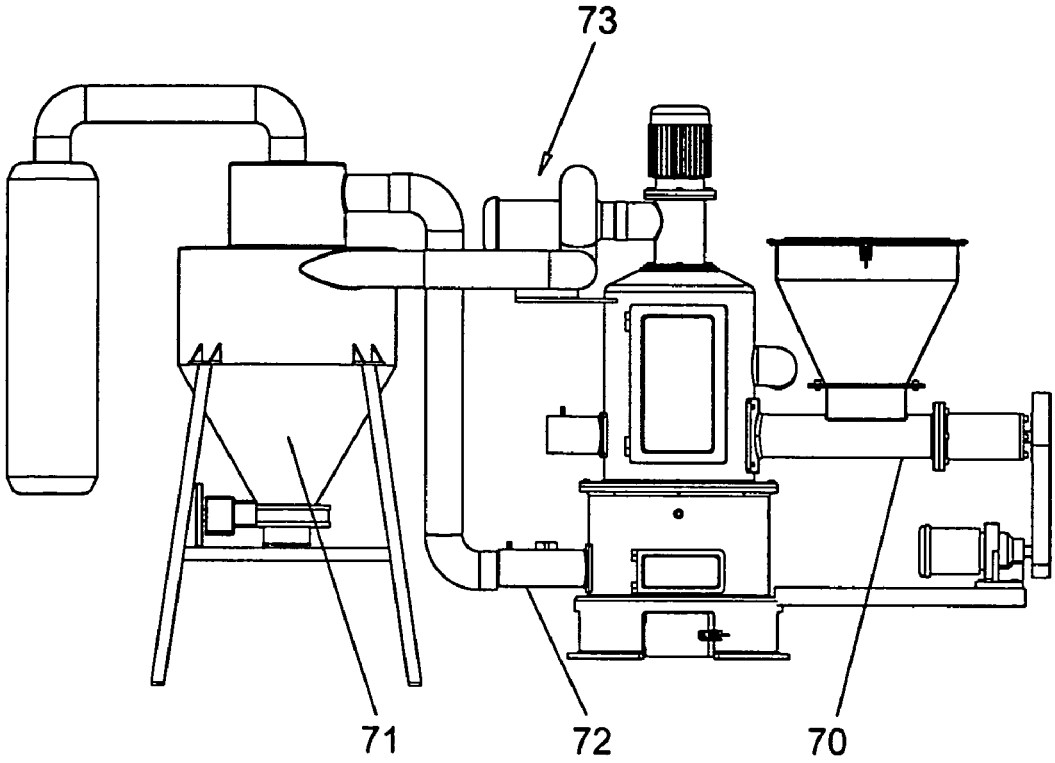
FIG. 13 is a schematic illustration of the grinding mill of the present invention in conjunction with a feeding apparatus. a collecting apparatus and a fan apparatus.

The invention claimed is:

1. A grinding mill, comprising:

a grinding ring;

an excentric disc, defining a horizontal plane, placed Inside said grinding ring and having a periphery with a plurality of seats, each seat having two radially oriented lateral walls into which horizontally oriented elongated holes are cut and an extension piece that extends in a downward direction;

at least one grinding wheel, having a lower side with a base set into one of said seats and being placed next to said grinding ring; and a regulating device, further comprising at least one elastic plate assembly, having an upper end fastened to said base of each of said grinding wheels and a lower end that extends downward, at least one first adjusting device, each holding said base of one of said grinding wheels in one of said seats at a preset horizontal position, at least one covering plate, covering an outer side of said seat of one of said grinding wheels and having a hole, at least one second adjusting device, mounted on said hole of one of said covering plates, allowing adjustment of a distance between said grinding wheel and said grinding ring and adjustment of mutual orientations thereof to be parallel, and at least one third adjusting device, one said third adjusting device being mounted at said lower end of each said elastic plate assembly, fixing each said elastic plate assembly to said extension piece of one of said seats at a lower end thereof, determining an elastic force of each said elastic plate assembly, wherein said first, second and third adjusting elements allow adjustment of said distance and mutual orientation between said grinding wheel and said grinding ring as well as a grinding force.

2. The grinding mill according to claim 1, wherein each said elastic plate assembly has an arc-like shape.

3. The grinding mill according to claim 1, wherein each said elastic plate assembly on said lower end thereof has an elongated incision.

4. The grinding mill according to claim 1, wherein said first, second and third adjusting elements each comprise a threaded rod and/or nuts.

5. The grinding mill according to claim 1, further comprising:

a separator, used in conjunction with said grinding mill and mounted in a main body thereof on a rotating vertical separator shaft, said separator comprising two support rings of equal sizes and shapes, mounted on top of each other, having openings surrounded by a plurality of fixing holes; and a plurality of blades, having vertical rods that are put through said fixing holes of said two support rings.

6. The grinding mill according to claim 5, wherein said blades are surrounded by a guiding device.

7. The grinding mill according to claim 6, wherein said guiding device comprises a drum body, having a peripheral surface with a plurality of openings which are covered by inclined lids fixed to one edge, and a pan, mounted below said drum body at a vertically adjustable distance.

8. The grinding mill according to claim 7, wherein said inclined lids point outwards.

9. The grinding mill according to claim 7, wherein said inclined lids point inwards.

10. The grinding mill according to claim 7, wherein said inclined lids alternatingly point inwards and outwards.

11. The grinding mill according to claim 7, wherein an extension ring is attached to an upper side of said drum body.

* * * * *